US005730038A

United States Patent [19]

Evans et al.

[11] Patent Number: 5,730,038

[45] Date of Patent: Mar. 24, 1998

[54] CONFIGURATION FOR PAPER PUNCH PIN

[75] Inventors: Alfred J. Evans, Lake In The Hills; Balaji Kandasamy, Chicago; David Q. Feng, Arlington Heights, all of Ill.

[73] Assignee: Acco USA, Inc., Wheeling, Ill.

[21] Appl. No.: 770,020

[22] Filed: Dec. 19, 1996

Related U.S. Application Data

[63] Continuation-in-part of Ser. No. 378,167, Jan. 25, 1995, abandoned.

Related U.S. Application Data

[60] Provisional application No. 60/031,087, Nov. 18, 1996.

[51] Int. Cl.[6] ..... B21D 22/28

[52] U.S. Cl. ..... 83/686; 83/689

[58] Field of Search ..... 83/167, 684, 685, 83/686, 687, 688, 689, 694

[56] References Cited

U.S. PATENT DOCUMENTS

| | | | |
|---|---|---|---|
| 1,887,360 | 11/1932 | Olsen | 83/684 |
| 2,244,660 | 6/1941 | Carpenter | 83/167 |
| 3,320,843 | 5/1967 | Schott, Jr. | 83/689 |
| 3,504,588 | 4/1970 | Thomas | 83/689 |
| 3,656,394 | 4/1972 | McCutcheon | 83/689 |
| 3,721,144 | 3/1973 | Yamamori | 83/689 |
| 4,257,300 | 3/1981 | Muzik | 83/689 |
| 4,449,436 | 5/1984 | Semerjian et al. . | |
| 4,713,995 | 12/1987 | Davi | 83/167 |
| 4,763,552 | 8/1988 | Wagner . | |
| 4,930,384 | 6/1990 | Nakatsuji | 83/689 |
| 5,029,392 | 7/1991 | Bingham et al. | 83/689 |
| 5,052,207 | 10/1991 | Porucznik | 83/689 |
| 5,243,887 | 9/1993 | Bonge, Jr. . | |
| 5,247,863 | 9/1993 | Cohen | 83/167 |

FOREIGN PATENT DOCUMENTS

| | | | |
|---|---|---|---|
| 0 268 162 | 5/1988 | European Pat. Off. . | |
| 26 31 117 | 1/1978 | Germany . | |
| 61-172629 | 1/1986 | Japan . | |
| 61-172 629 | 8/1986 | Japan | 83/684 |
| 4-105 899 | 4/1992 | Japan | 83/684 |
| 4-105899 | 4/1992 | Japan . | |

OTHER PUBLICATIONS

Ostergaard, D.E., Advanced Diemaking, McGraw–Hill Book Company, pp. 72–73, publication date unknown.

Ostergaard, D.E., Basic Diemaking, McGraw–Hill Book Company, pp. 2, 3, 10–13, publication date unknown.

*Primary Examiner*—Maurina T. Rachuba

*Attorney, Agent, or Firm*—Pennie & Edmonds LLP

[57] ABSTRACT

A punch for punching holes in a stack of sheets of paper having a V-shaped groove with a height based on the thickness of the stack and the forces necessary to drive the punch pin of the punch through the stack of paper.

8 Claims, 13 Drawing Sheets

CONFIGURATION FOR PAPER PUNCH PIN

CROSS REFERENCE TO RELATED APPLICATIONS

This application is a continuation-in-part of applicants' application Ser. No. 08/378,167, filed Jan. 25, 1995, abandoned. This application also claims the benefit of U.S. provisional application No. 60/031,087, filed Nov. 18, 1996.

BACKGROUND OF THE INVENTION

Non-flat punch pins have been proposed for and used in paper punch apparatus (U.S. Pat. Nos. 4,257,300; 4,449,436 and 4,763,552). While some of these punches have operated satisfactorily, they do require a certain amount of force to punch a hole through a stack of paper. This, in turn, requires that the parts of the punch be constructed to withstand these forces. The bigger the stack of paper to be punched, the higher the punching force required. This is particularly noticeable with manually operated punches where the individual has to apply the punching force.

SUMMARY OF THE INVENTION

The present invention is an improvement in the prior art punches, requiring less force to effect a punching operation. Broadly, the present invention comprises a punch pin having a V-shaped groove sized and configured to punch stacks of paper sheets which vary through a range of heights. With the present invention, the groove is constructed with a height greater than the maximum height of the stack being punched. In addition, other constructional details of the conventional punch pin have been modified to produce a punch pin having a significant reduction in the force required to operate it.

DETAILED DESCRIPTION OF THE INVENTION

Figure 1:
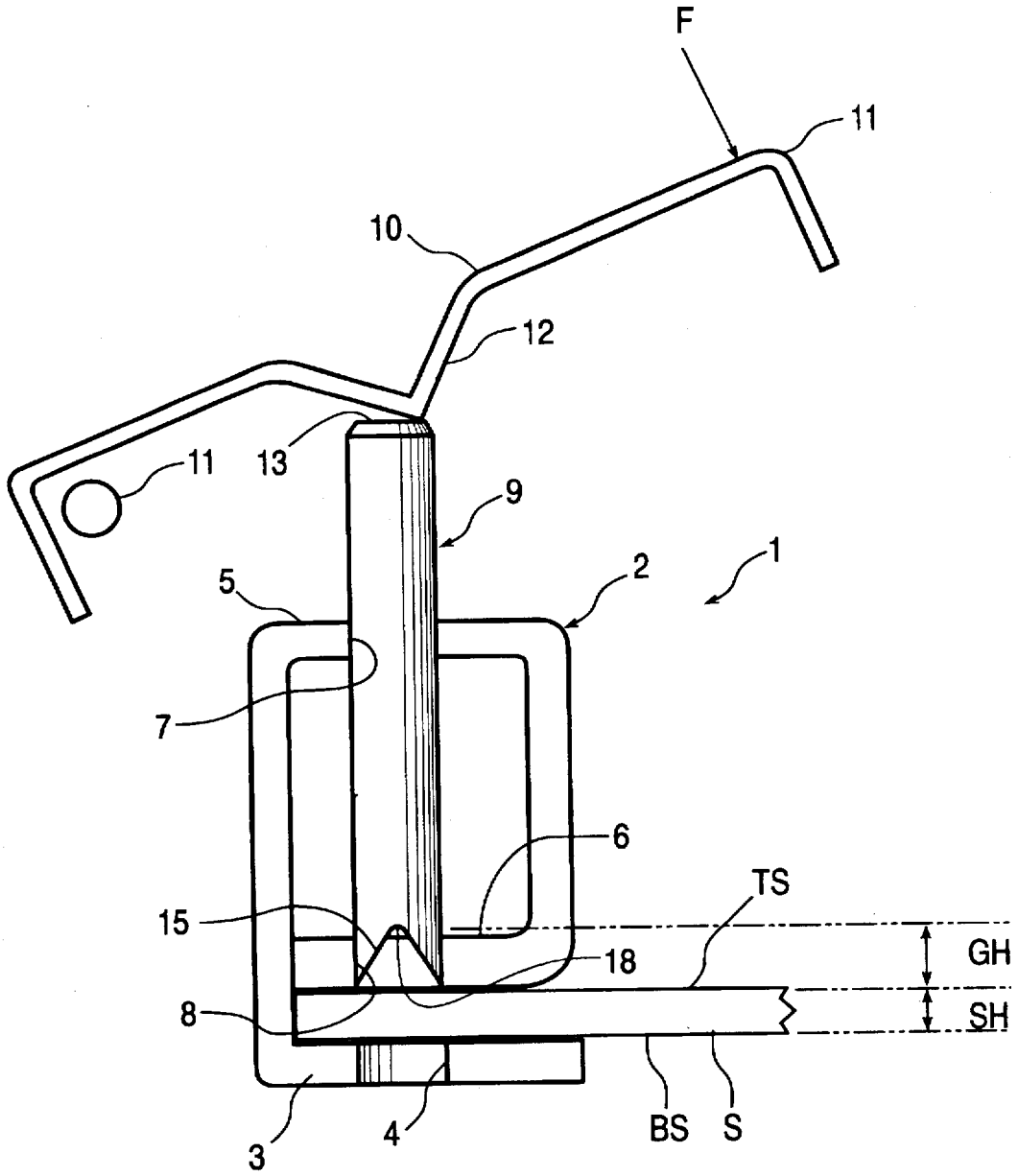
FIG. 1 is a side elevational view of the punch including the configured punch pin of the present invention.
Figure 2:
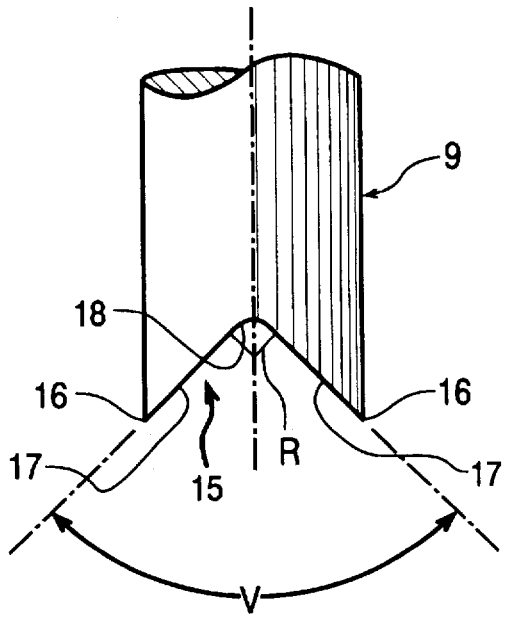
FIG. 2 is an enlarged partial elevational view of the punch pin of the present invention.

As shown in FIG. 1, the punch 1 of the present invention includes a punch frame 2 having a punch base 3 with a paper die outlet opening 4. The punch frame also includes a horizontal punch frame member 5 and a paper thickness limit member 6. Each of these members contains a punch guide opening 7, 8, respectively, for mounting a punch pin 9 for movement along the longitudinal axis of the punch pin. The guide openings 7 and 8 are axially aligned, along the longitudinal axis of the punch pin 9, with the paper die outlet opening 4, whereby longitudinal movement of the punch pin in a downward direction will cause the punch pin to move into the paper outlet opening 4.

The movement of the punch pin is effected by a punch pin drive member 10, pivotally mounted for rotation about a point 11. Pivoting movement of the drive member in a downward directed is effected by applying a force F against the extended end 11 of the drive member. This causes an intermediate drive surface 12 to engage the upper first end 13 of the punch pin 9 and move it downwardly.

Figure 4:
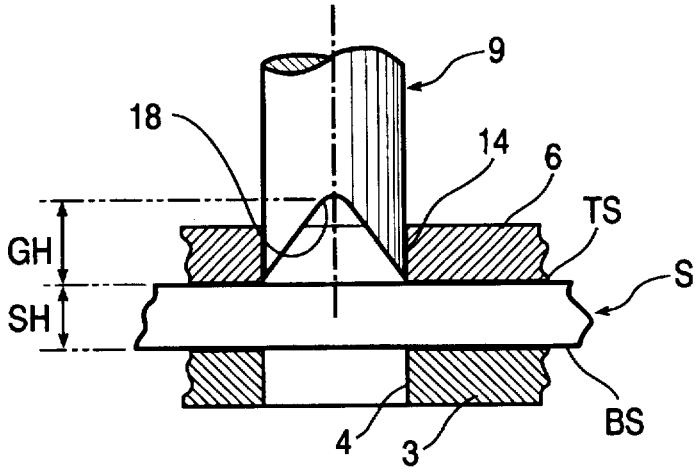
FIG. 4 is an enlarged partial elevational view of the punch pin of the invention about to penetrate a multiple sheet stack of paper.
Figure 5A:
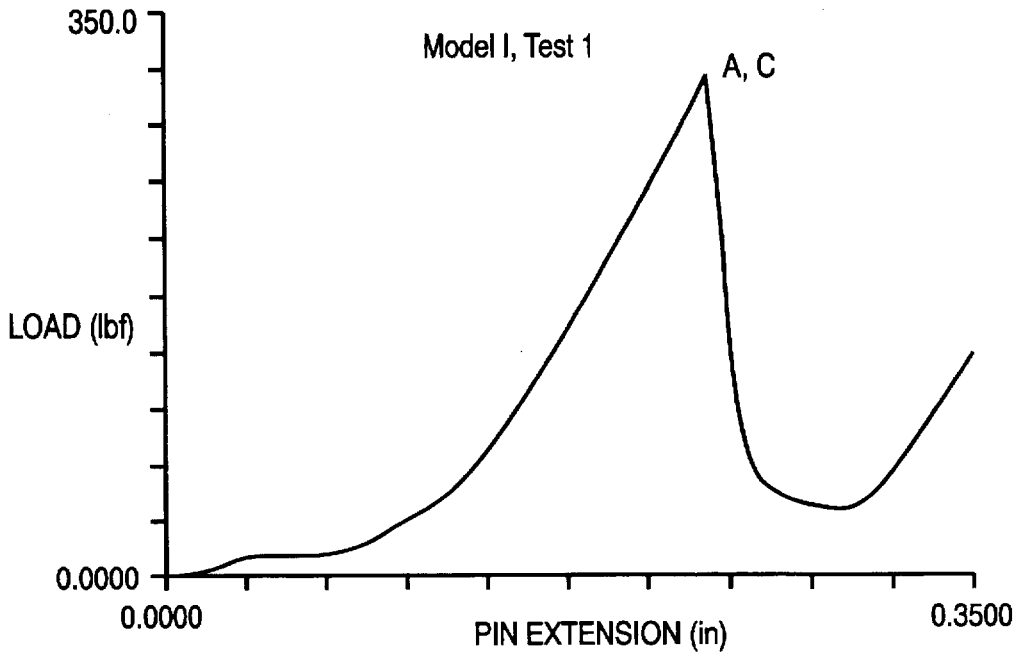
FIG 5A PRIOR ART
FIGS. 5*a*–5*c* are graphs showing the force loading of the punch pin versus the pin extension for a first prior art model.
Figure 5B:
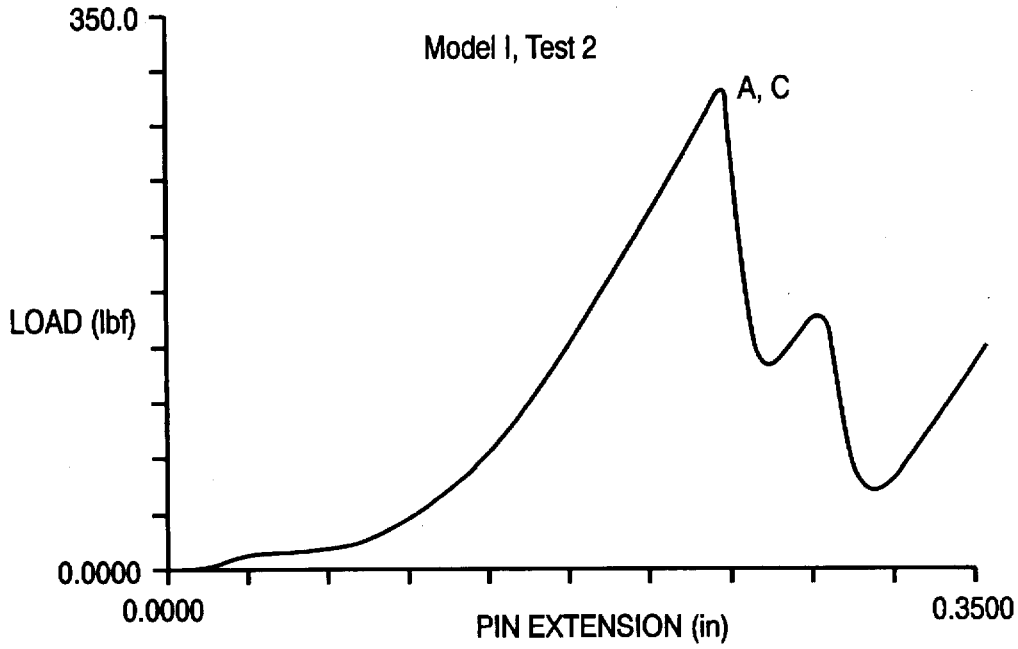
FIG 5B PRIOR ART
Figure 5C:
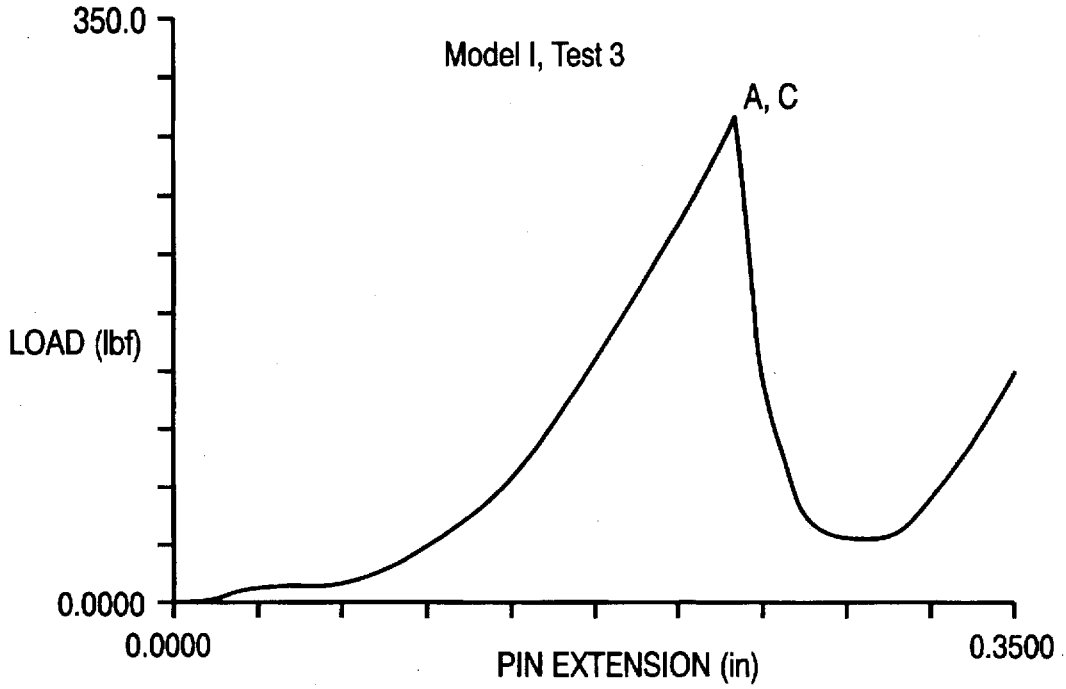
FIG 5c PRIOR ART
Figure 5D:
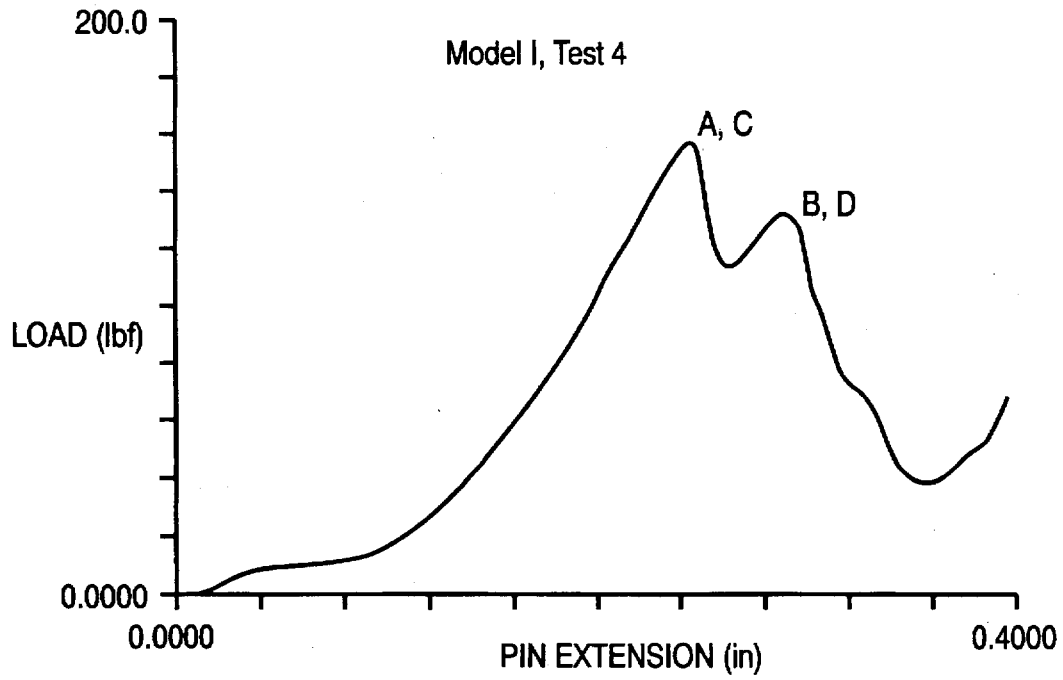
FIGS. 5*d*–5*f* are charts similar to those of FIGS. 5*a*–5*c*, showing the force loading versus pin extension for the first model, constructed according to the present invention.
Figure 5E:
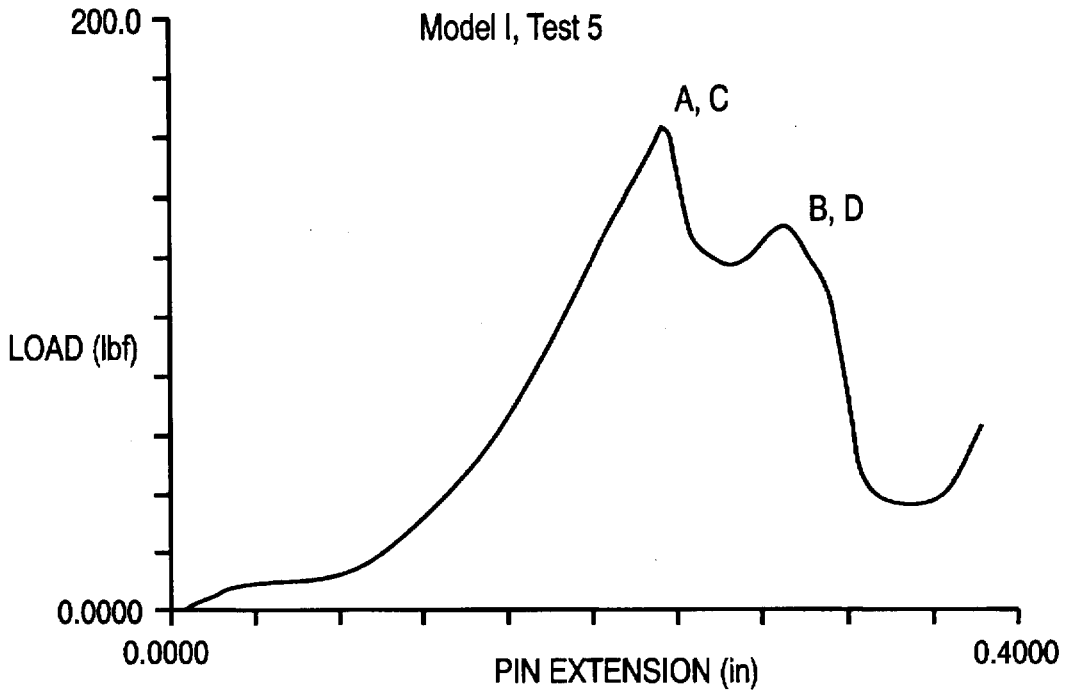
Figure 5F:
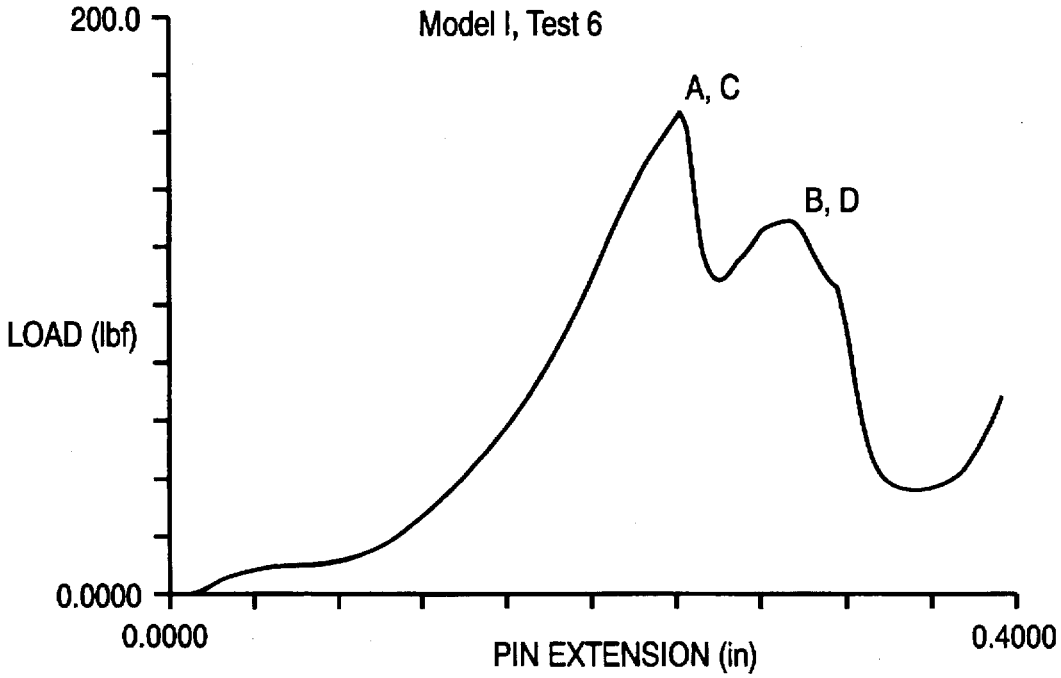
Figure 6A:
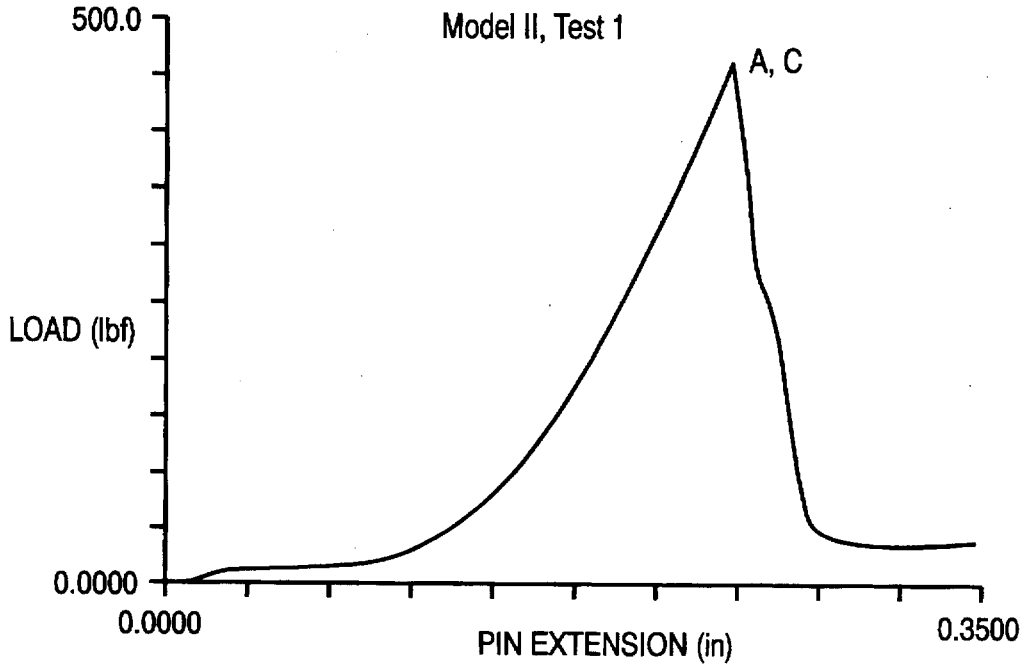
FIG 6A PRIOR ART
FIGS. 6*a*–6*c* are graphs similar to those of FIGS. 5*a*–5*c* for a second prior art model.
Figure 6B:
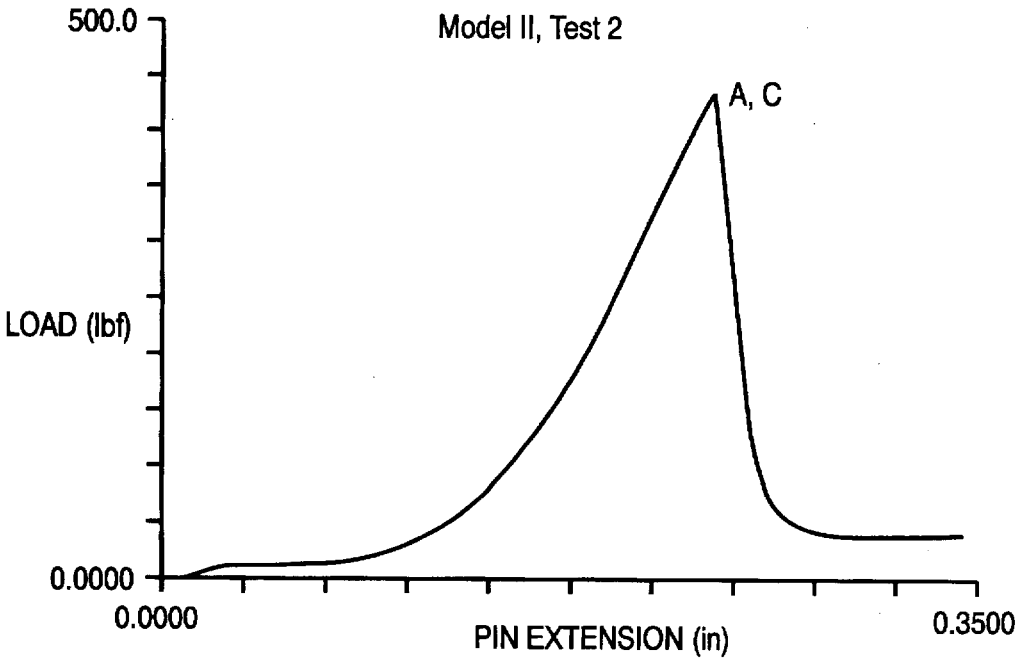
FIG 6B PRIOR ART
Figure 6C:
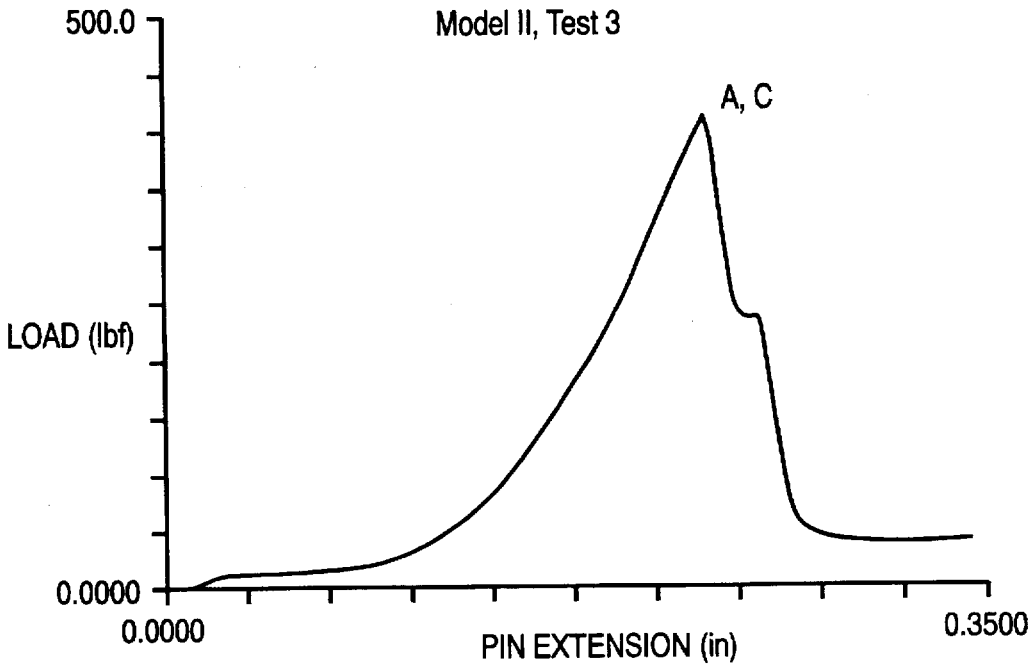
FIG 6C PRIOR ART
Figure 6D:
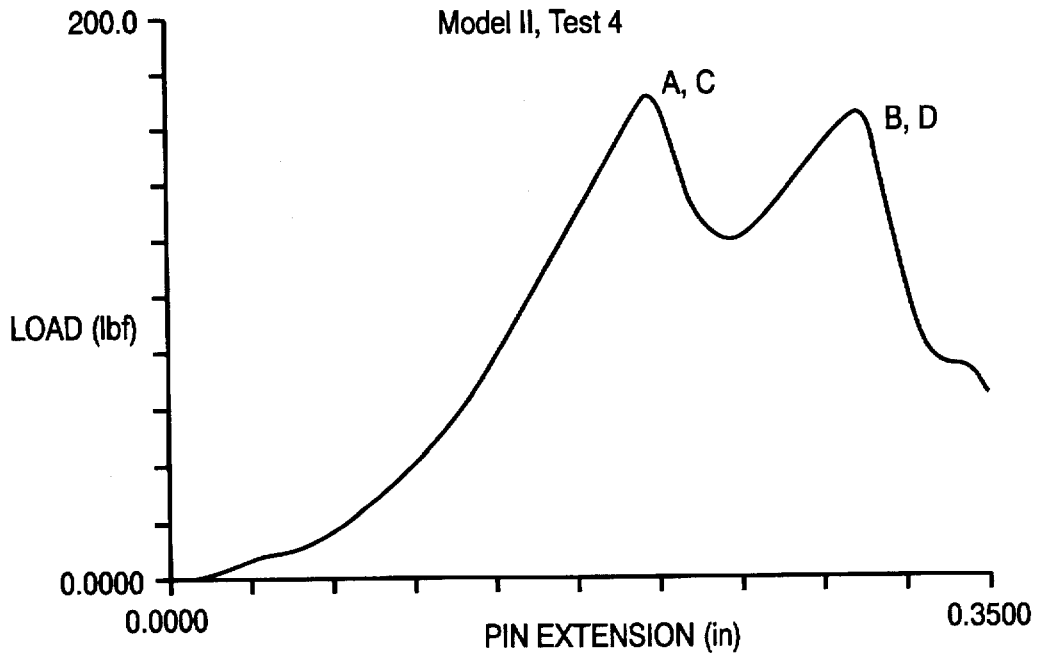
FIGS. 6*d*–6*f* are graphs similar to those of FIGS. 5*d*–5*f* for the second model, constructed according to the invention.
Figure 6E:
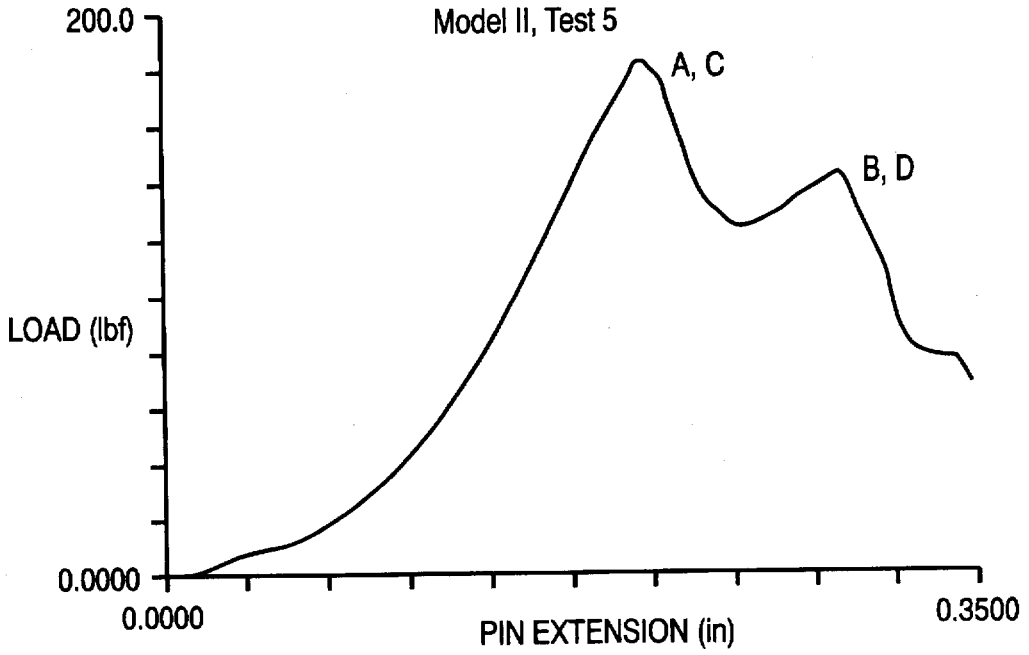
Figure 6F:
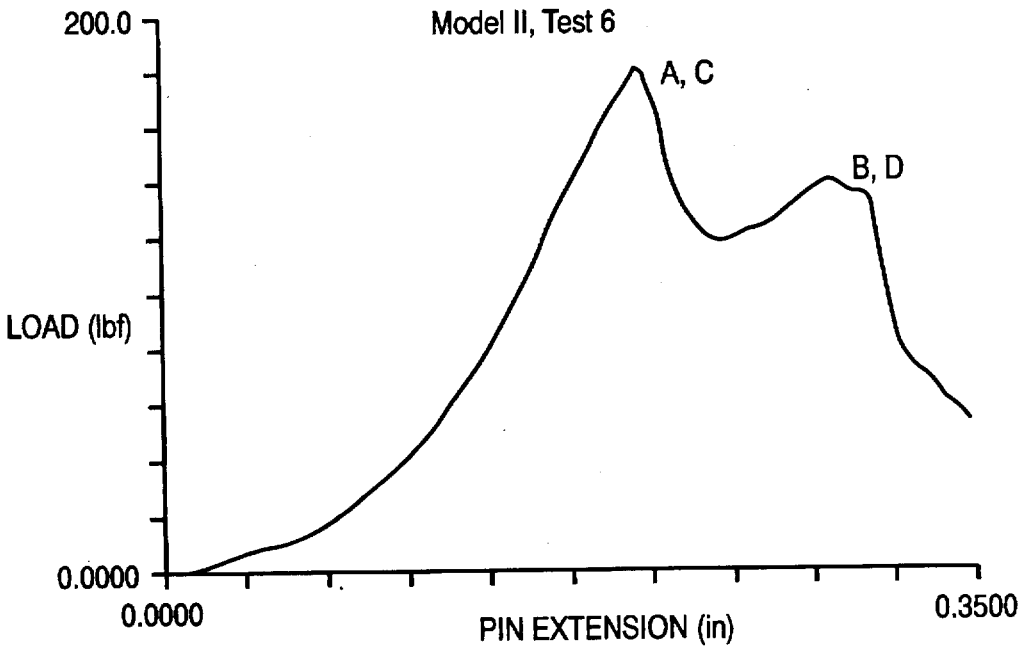
Figure 7A:
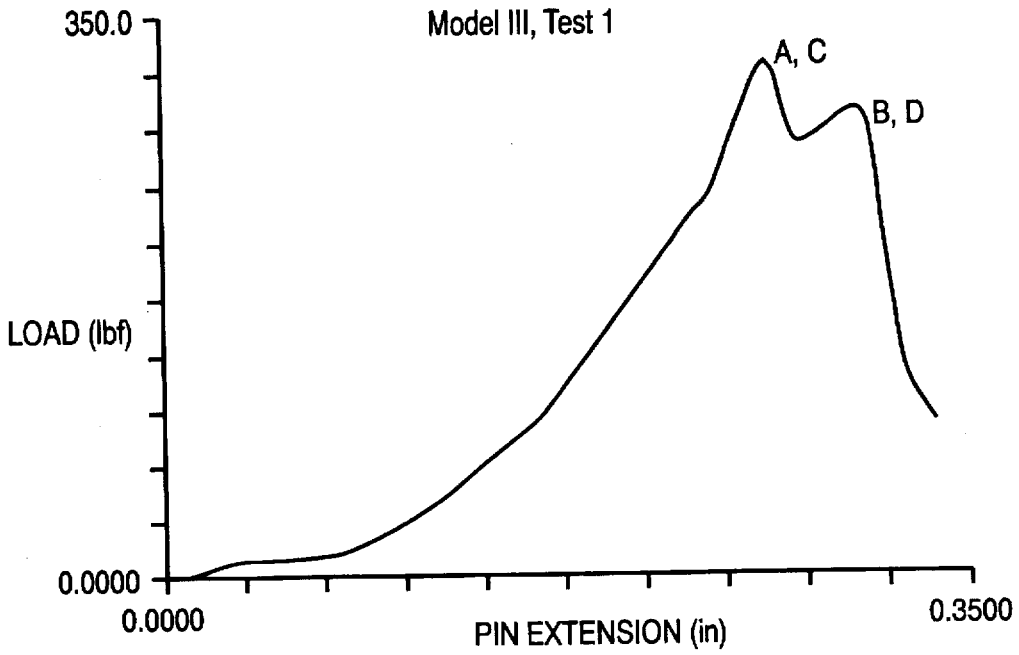
FIG 7A PRIOR ART
FIGS. 7*a*–7*c* are graphs similar to FIGS. 5*a*–5*c* for a third prior art model.
Figure 7B:
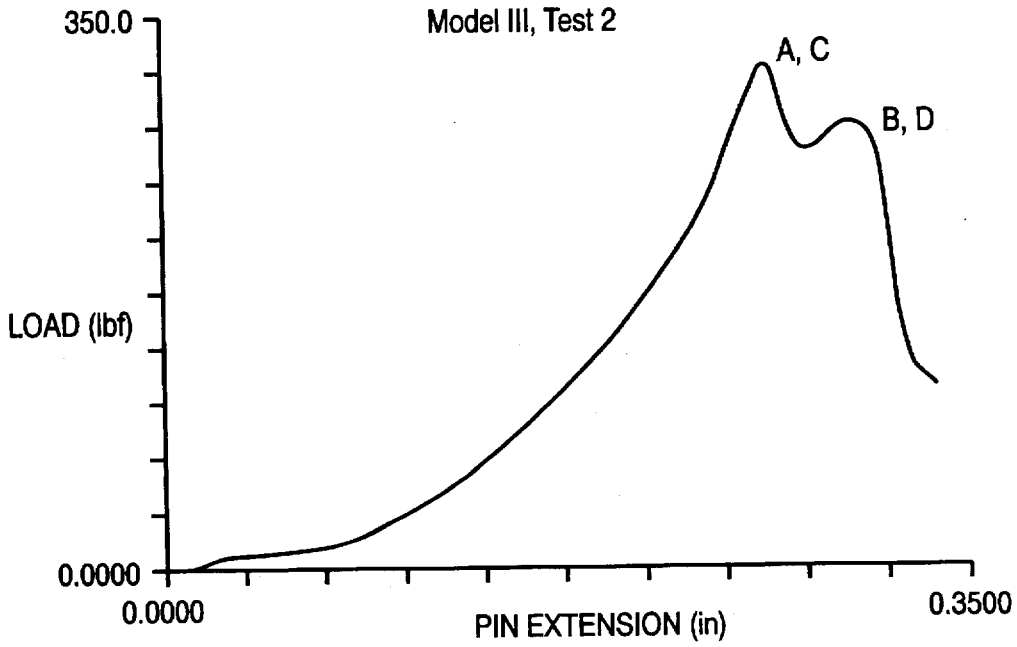
FIG 7B PRIOR ART
Figure 7C:
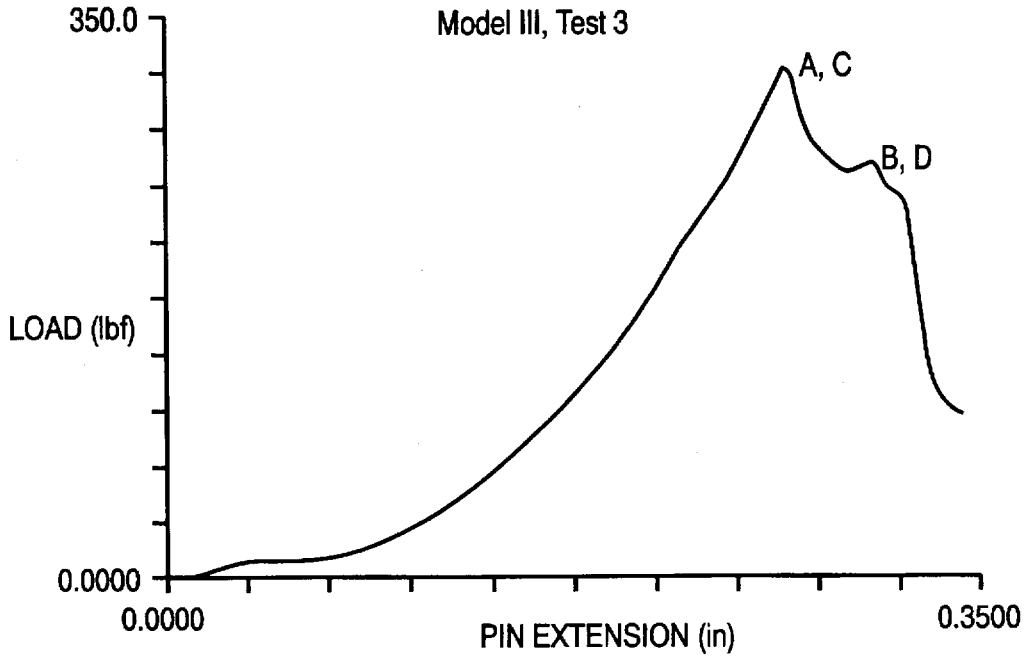
FIG 7c PRIOR ART
Figure 7D:
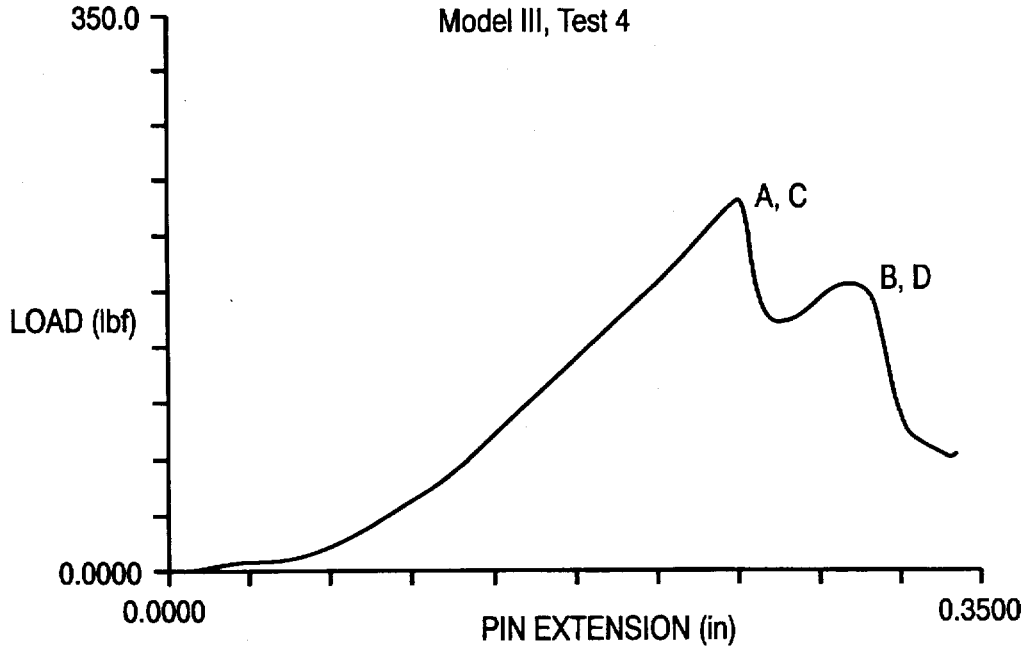
FIGS. 7*d*–7*f* are graphs similar to FIGS. 5*d*–5*f* for the third model, constructed according to the present invention.
Figure 7E:
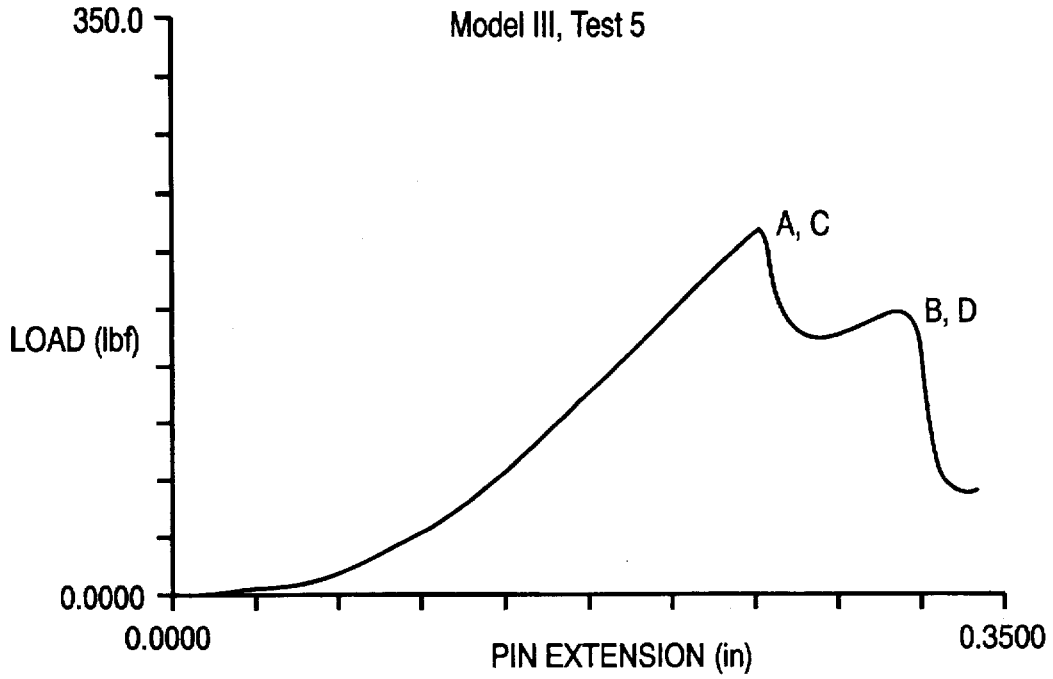
Figure 7F:
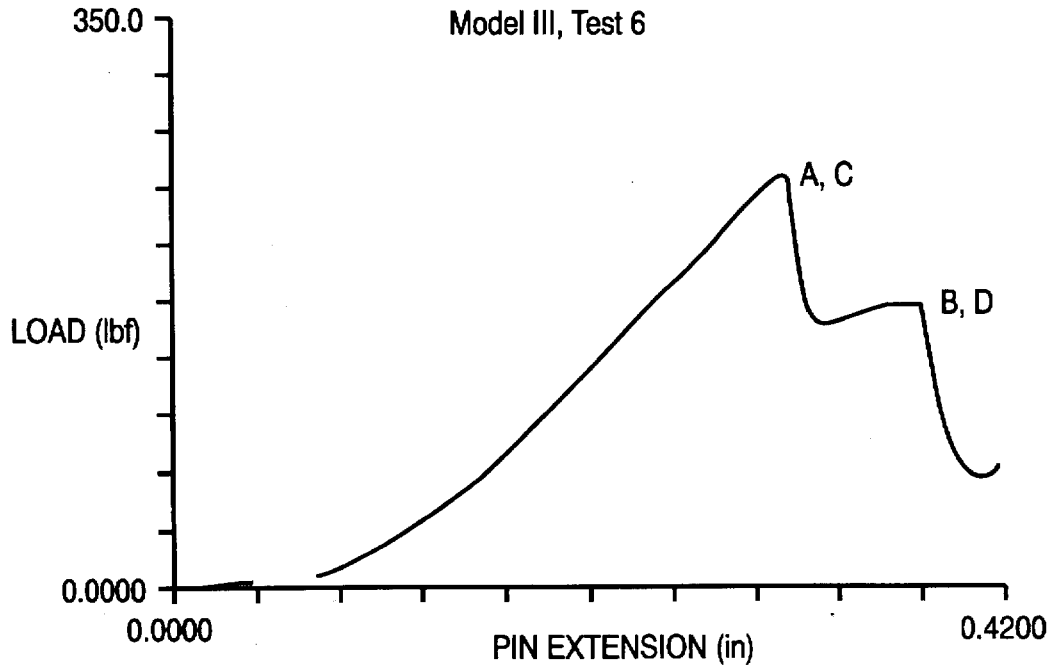

As shown in FIGS. 1 and 4 the paper thickness limit member 6 is spaced above the punch base 4 to define a paper stack opening having a stack height SH, as measured along the longitudinal axis of the punch pin. This stack height SH is equal to a maximum thickness of a multiple sheet stack of paper S through which a hole is to be punched by the punch pin 9.

As shown in FIGS. 1 and 4, the lower second end 14 of the punch pin 9 will, upon downward movement, move through the stack S of paper, passing from the top sheet TS through the bottom sheet BS, and into the opening 4 in the base member 3. In practice, the punch will typically include two or more punch pins for punching two or more holes in the stack of paper. For purposes of clarity, only one punch pin is shown in the drawings.

Figure 3:
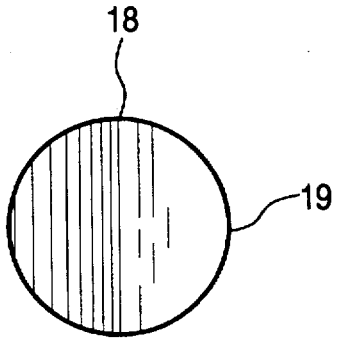
FIG. 3 is a bottom view of the punch pin of FIG. 2.

In accordance with the teachings of the present invention, the lower end 14 of the punch pin is shaped to define a single inverted V-shaped groove 15. The groove includes terminal ends 16 disposed on diametrically opposite sides of the punch pin and in a plane extending perpendicular to the longitudinal axis of the punch pin. The body portion of the punch pin, at least at its lower end 14, is cylindrical in cross-section. The V-shaped groove 15 includes flat side surfaces 17 and an upper curved surface 18 connecting the two side surfaces 17. The side surfaces together with the curved surface have a peripheral edge which defines the cutting edge 19 (FIG. 3) of the punch pin.

In order to reduce the maximum force that is required to operate the punch in punching a hole through a stack of paper of maximum height, it has been found that the configuration of the lower end of the punch pin is critical. Most importantly the height GH of the V-shaped groove 15 needs to be greater than the height SH of the stack opening into which a stack of paper S can be inserted for punching. Also, of importance is the radius R to which the curved surface 18 is shaped as well as the included angle V between the side surfaces 17 of the V-shaped groove.

In the following Chart A, the ratio between the groove height GH and the paper stack height SH, as well as the other dimensions of the punch pin are given for three different punch models. This information is given for both old prior art models and corresponding reconfigured new models made in accordance with the present invention. In addition, Chart A shows the average maximum peak force required for effecting a punching operation, both for the old models and for the new models of the present invention.

In accordance with the present invention, the punch has the following dimensional characteristics:

(a) Ratio of Groove Height GH to Stack Height SH of between about 1.2 and 2 and preferably between about 1.25 and 1.56;

(b) Radius R of upper curved surface of V-shaped groove between about 0.04 and 0.06 inches;

(c) Angle V of V-shaped groove between about 60° and 75°;

(d) Height GH of V-shaped groove between about 0.130 and 0.190 inches and preferably between about 0.130 and 0.160 inches;

(e) Pin diameter between about 0.25 and 0.28 inches; and (f) Stack opening with a stack height of between about 0.104 and 0.149 inches.

CHART A

| Punch Pin Configuration (Old and New) and Maximum Peak Force Required | | | |
|---|---|---|---|
| Model | Paper Capacity (20 lb., average paper thickness of 0.003725 in.) No. of Sheets | Paper Stack Height SH (in.) | Pin Diameter (in.) |
| I | 28 | 0.104 | 0.25 |
| II | 32 | 0.119 | 0.281 |
| III | 40 | 0.149 | 0.281 |

| OLD PUNCH PINS OF PRIOR ART | | | | | |
|---|---|---|---|---|---|
| Model | Height GH of V-Shaped Groove (in.) | Radius R of Upper Surface of V-Shaped Groove (in.) | Angle V of V-Shaped Groove (degrees) | Ratio of Groove Height GH to Stack Height SH | Average Maximum Peak Force (lbs.) |
| I | 0.072 | 0.06 | 120 | 0.69 | 302.5 |
| II | 0.063 | 0.201 | radius | 0.53 | 442.1 |
| III | 0.136 | 0.06 | 78 | 0.91 | 323.2 |
| | 0.130 | 0.05 | 75 | 1.25 | 164.7 |
| | 0.163 | 0.05 | 70 | 1.37 | 180.5 |
| | 0.190 | 0.05 | 61 | 1.28 | 237.5 |

| Model | Improvement In Maximum Force Reduction of New Over Old |
|---|---|
| I | 46% |
| II | 59% |
| III | 27% |

The information contained in chart A regarding the maximum peak force requirements of the punch is a result of tests that were conducted on each of the three models identified in Chart A. The tests for Model I are represented by the graphs of FIGS. 5a–5f with the maximum peak force being shown at A. The amount of punch pin extension at this maximum peak force is designated by reference C in the graphs. The first three graphs (5a–5c) represent the results for three testings of one sample of the prior art version of Model I, having the dimensions set forth in Chart A. The second of the three graphs (FIGS. 5d–5f) represent the results of the same Model I, constructed in accordance with the present invention and also with the dimensions as set forth in Chart A. The graphs of FIGS. 6a–6f and FIGS. 7a–7f represent the results of tests on Models II and III both old (FIGS. 6a–6c and 7a–7c) and new (FIGS. 6d–6f and 7d–7f).

For the punch constructions of each of the models I, II and III which are made according to the present invention, the force requirement for effecting a punching operation is divided into a maximum peak force A, with a punch pin extension of C, and a subsequent secondary peak force B, with a punch pin extension of D. See FIGS. 5d–5f, 6d–6f and 7d–7f. With the prior art versions of models I and II there is no secondary peak force. Only a single maximum peak force A is encountered at a punch pin extension of C. In this regard, the second test of Model I shown in the graph of FIG. 5b does indicate a double peak. It is believed, however, that this is an anomaly and that the second peak was caused due to a sticking of the punch pin or for some other unknown reason. It is clear from the graphs of FIGS. 5a and 5c of the same sample of Model I that there is no secondary peak.

Although the prior art versions of the first two models produce only a single maximum peak force, the prior art version of Model III does produce both a maximum peak force A and secondary peak force B, similar to that encountered with all models when constructed according to the present invention.

The numerical values of the forces A and C and the corresponding pin extension values B and D shown on the graphs of FIGS. 5–7 are set out on the following Chart B.

CHART B

| Model and Test No. | A Maximum Peak Force (lbs.) | B Secondary Peak Force (lbs.) | C Punch Pin Extension at Maximum Peak Force (in.) | D Punch Pin Extension at Secondary Peak Force (in.) |
|---|---|---|---|---|
| Model I Test | | | | |
| old 1 | 310.9 | | 0.2361 | |
| old 2 | 303.4 | | 0.2379 | |
| old 3 | 293.3 | | 0.2333 | |
| new 4 | 157.4 | 132.5 | 0.2501 | 0.2950 |
| new 5 | 167.7 | 134.4 | 0.2483 | 0.3060 |
| new 6 | 169.0 | 130.6 | 0.2483 | 0.2997 |
| Model II Test | | | | |
| old 1 | 467.7 | | 0.2442 | |
| old 2 | 441.1 | | 0.2428 | |
| old 3 | 417.4 | | 0.2355 | |
| new 4 | 173.0 | 166.3 | 0.2057 | 0.2979 |
| new 5 | 185.2 | 144.1 | 0.2083 | 0.2947 |
| new 6 | 183.4 | 142.8 | 0.2052 | 0.2915 |
| Model III Test | | | | |
| old 1 | 325.8 | 296.6 | 0.2756 | 0.3173 |
| old 2 | 324.1 | 286.3 | 0.2769 | 0.3125 |
| old 3 | 319.6 | 258.6 | 0.2726 | 0.3117 |
| new 4 | 233.0 | 180.0 | 0.3055 | 0.3636 |
| new 5 | 226.8 | 174.7 | 0.3089 | 0.3796 |
| new 6 | 252.6 | 172.6 | 0.3099 | 0.3780 |

It will readily be seen from the graphs of FIGS. 5–7 and from Charts A and B that the maximum peak force for the new models is considerably less than that for the corresponding old prior art models. As indicated at the bottom of Chart A the improvement with the present invention results in a reduction in the maximum peak force of between 27 and 59%. This reduction in maximum force not only makes it easier for the operator to manually effect a punching operation, but also permits the use of less expensive materials for manufacturing the punch due to the fact that the forces to which the materials will be subjected are less.

Figure 8:
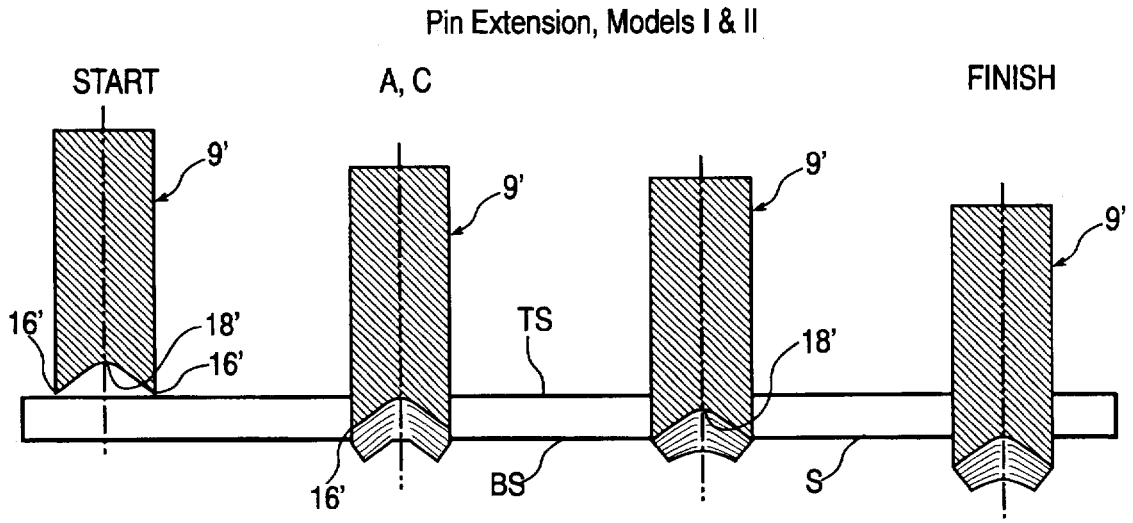
FIG 8 PRIOR ART
FIG. 8 is a schematic view, in partial cross-section, showing one embodiment of a punch pin of the prior art, in various positions of extension.
Figure 9:
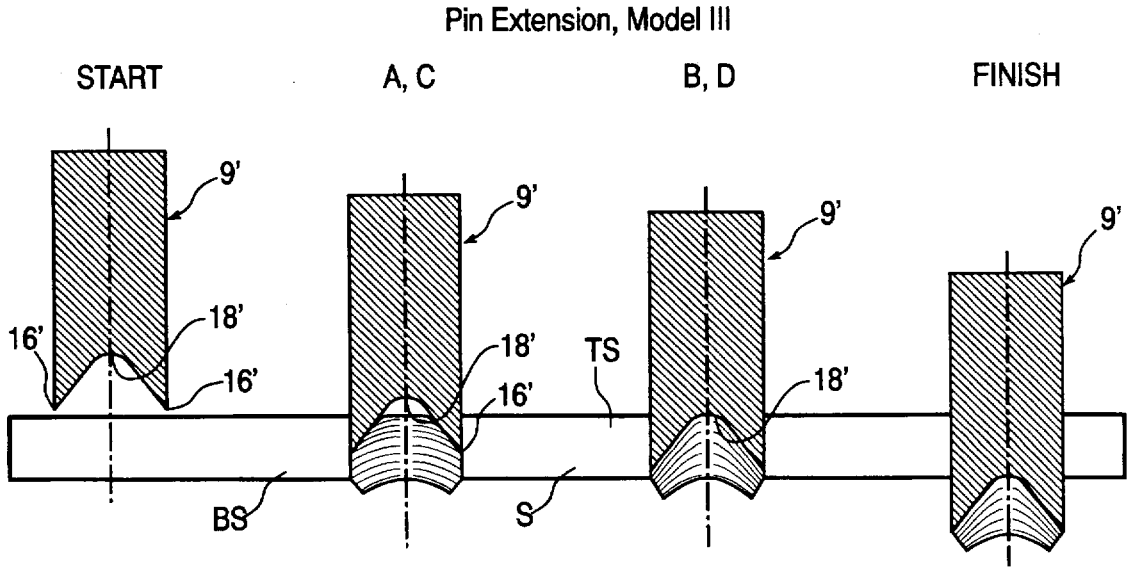
FIG 9 PRIOR ART
FIG. 9 is a view similar to FIG. 8, showing another embodiment of a punch pin of the prior art.
Figure 10:
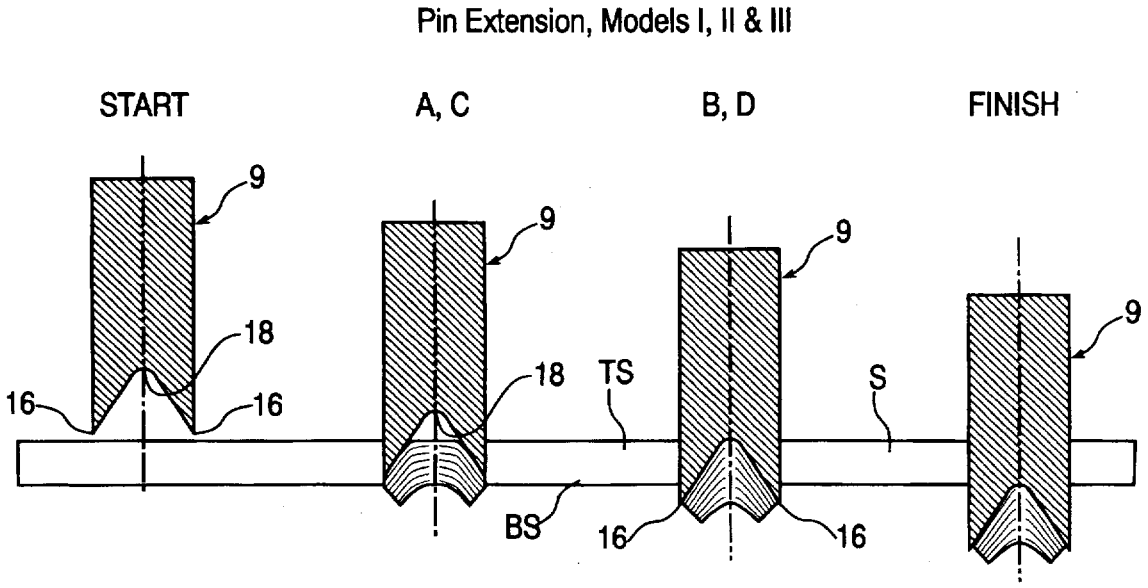
FIG. 10 is a view similar to FIG. 8, showing the punch pin extension at various positions for a punch pin according to the present invention.

FIGS. 8, 9 and 10 show the various positions of the punch pin as it is moved through a punching operation. The first and last positions represent the start and finish positions of the punch pin while the second and third positions represent the location of the punch pin when encountering the different peak forces A and B.

In particular, FIG. 8 shows the punch pin positions for the old prior art versions of Models I and II, where only a single maximum peak force A is encountered. FIG. 9, on the other hand, shows the punch pin positions for the prior art version of the Model III where a secondary peak force C is also encountered. Finally, FIG. 10 shows the punch pin positions for all versions of Models I, II and III, when constructed according to the teachings of the present invention.

It has been determined that in the cutting operation produced by the punch pin passing through the stack of paper, the cutting does not all take place strictly as a sheering operation between the cutting edge of the punch pin and the die opening. In paper punches, punching takes place by the punch pin entering the paper of the stack and compressing and bending the aligned paper into the center of the punch pin. This compression builds up as the punch pin is moved through the stack and reaches a maximum when the top sheet TS engages against the upper curved surface of the V-shaped groove. Without sufficient space in the punch pin for the paper to go, the paper is placed under high compression and this causes the maximum peak force to be correspondingly high. In some situations this can cause stalling of the punch pin.

With the prior art constructions of the punch pin where the height of the V-shaped groove is less than the height of the stack of paper being punched, undesirable high compression of the stack occurs because there is not a sufficient amount of empty space for accommodating the paper being punched. As shown in the second position of the prior art punch pins in FIGS. 8 and 9 the maximum peak force corresponds to the location of the pin when the curve surface 18' of the v-shaped groove is engaging against the top sheet TS of the stack (FIG. 8) or very close to the top sheet (FIG. 9). At this time the terminal ends 16' of the punch pin are still located in the body of the stack S, at a considerable distance above the bottom sheet BS.

In contrast, the punch pin of the present invention, when reaching the maximum peak force, still provides considerable space between the top sheet TS and the upper surface 18 of the V-shaped groove. At the same time, the terminal ends 16 of the punch pin have nearly cut entirely through the body of the stack S down to the bottom sheet BS. Thus, the high compression encountered with the prior art constructions is not encountered with the construction of the present invention. This, in turn, results in a decrease in the maximum force required to effect a punching operation.

Further, with the punch pin of the present invention, the secondary peak load is encountered at a different position of the punch pin than with the prior art construction of Model III. FIG. 10 shows that the secondary peak force is encountered with the punch pin of the invention when the curved upper surface 18 of the V-shaped groove is generally aligned horizontally with the top sheet TS of the stack of paper underneath the punch pin. At this time the bottom terminal ends 16 have already passed through the bottom sheet BS of the stack of paper. With the prior art construction of Model III, which encounters a secondary peak force, such force is encountered when the terminal ends 16' are just passing through the bottom sheet BS of the stack and the upper curve surface 18' is located in the body of the stack S.

Finally, it is to be noted that the numerical amount of pin extension in columns C and D of Chart B, contain an increment which corresponds to the vertical spacing of the punch pin above the stack at the start position, as shown at the left of FIGS. 8, 9 and 10. Also, with respect to the positions of the prior art punch pin as shown in FIG. 8, since their is only one maximum peak force and no secondary peak force, the punch pin position shown third from the left in FIG. 8 corresponds to the punch pin as it is moving downwardly along the slope of the curve shown in FIGS. 5*a*, 5*c*, 6*a*, 6*b* and 6*c*. As far as the secondary peak force shown in FIG. 5*b*, it is believed that this peak could possibly occur at the time the lower terminal ends 16' of the punch pin are exiting the bottom sheet BS of the stack. Thus, this position of the punch pin is shown in FIG. 8.

We claim:

1. A paper punch comprising:

a) a punch pin having a longitudinal axis;

b) a punch frame having a punch base with a paper outlet opening and a frame member disposed above said base and mounting said punch pin for movement along its longitudinal axis and into said outlet opening;

c) a paper thickness limit member containing a punch guide opening aligned along said longitudinal axis with said outlet opening, said paper thickness limit member being spaced at a predetermined height above said punch base to define a stack opening having a stack height, as measured along said longitudinal axis, equal to a maximum thickness of a multiple sheet stack of paper through which a hole is to be punched, from a top sheet of said stack to a bottom sheet thereof;

e) a punch pin drive member mounted on said punch frame and requiring a predetermined maximum peak force and a subsequent secondary peak force to move said punch pin through said maximum thickness of said multiple sheet stack of paper; and f) said punch pin having a body portion of cylindrical shape and opposite first and second ends;

i) said first end being positioned for engagement by said drive member to effect movement of said punch pin toward said base opening, ii) said second end of said punch pin being positioned for movement through said stack opening and into said base opening upon engagement of the first end by said drive member, iii) said second end being shaped to define a single inverted V-shaped groove having lower terminal ends, side surfaces and an upper curved surface of a predetermined radius connecting said side surfaces, iv) said side surfaces and said curved surface having peripheral edges together defining a cutting edge, and v) said groove having a groove height, as measured along said longitudinal axis, from said terminal ends to said curved surface, which is the stack height of said stack opening to create said predetermined maximum peak force as said punch pin is moved through said stack of paper with the upper curved surface of said V-shaped groove above the predetermined height of said paper thickness limit member and above the top sheet of said stack and to create said secondary peak force with the upper curved surface of said V-shaped groove at the predetermined height of said paper thickness limit member and engaging the top sheet of said stack.

2. A punch comprising:

a) a punch pin having a longitudinal axis;

b) a punch frame having a punch base with a paper outlet opening and a frame member disposed above said base and mounting said punch pin for movement along its longitudinal axis and into said outlet opening;

c) a paper thickness limit member containing a punch guide opening aligned along said longitudinal axis with said outlet opening, said paper thickness limit member being spaced above said punch base to define a stack opening having a stack height, as measured along said longitudinal axis, equal to a maximum thickness of a multiple sheet stack of paper through which a hole is to be punched by said punch pin;

e) a punch pin drive member mounted on said punch frame; and f) said punch pin having a body portion of cylindrical shape and opposite first and second ends;

i) said first end being positioned for engagement by said drive member to effect movement of said punch pin toward said base opening, ii) said second end being positioned for movement through said stack opening and into said base opening upon engagement of the first end by said drive member, iii) said second end being shaped to define a single inverted V-shaped groove having lower terminal ends, side surfaces and an upper curved surface of a predetermined radius connecting said side surfaces, iv) said side surfaces and said curved surface having peripheral edges together defining a cutting edge, and v) said groove having a groove height, as measured along said longitudinal axis, from said terminal ends to said curved surface, of between about 1.2 to 2.0 times the stack height of said stack opening.

3. A punch according to claim 2, wherein:

a) said side surfaces of said V-shaped groove are flat surfaces.

4. A punch according to claim 3, wherein:

a) the curved surface of said V-shaped groove defines a radius of between about 0.04 and 0.06 inches.

5. A punch according to claim 4, wherein:

a) the V-shaped groove has an included angle between said side surfaces of between about 60 and 75 degrees.

6. A punch according to claim 5, wherein:

a) said groove has a height between about 0.130 and 0.160 inches.

7. A punch according to claim 6, wherein;

a) the body portion of said punch pin has a diameter of between about 0.25 and 0.28 inches;

b) the stack opening has a stack height of between about 0.104 and 0.149 inches;

c) the curved surface of said V-shaped groove defines a radius of about 0.05 inches; and d) the V-shaped groove has a height of between about 1.25 and 1.56 times the height of the stack opening.

8. A punch according to claim 7, wherein:

a) the lower terminal ends of said punch pin are on diametrically opposite sides of the body portion of the punch pin and lie in a plane extending perpendicular to said longitudinal axis.

* * * * *

UNITED STATES PATENT AND TRADEMARK OFFICE
CERTIFICATE OF CORRECTION

PATENT NO. : 5,730,038

DATED : March 24, 1998

INVENTOR(S) : Alfred J. Evans et al.

It is certified that error appears in the above-identified patent and that said Letters Patent is hereby corrected as shown below:

Claim 1, line 51, after "which is" insert --sufficiently greater than--.

Claim 3, line 1, change "claim 2" to --either claim 1 or 2--.

Signed and Sealed this

Eighth Day of September, 1998

*Attest:*

*Attesting Officer*

Bruce Lehman

BRUCE LEHMAN

*Commissioner of Patents and Trademarks*